US008143796B2

(12) United States Patent
Yamahara et al.

(10) Patent No.: US 8,143,796 B2
(45) Date of Patent: Mar. 27, 2012

(54) ELECTRONIC BALLAST WITH CONTROLLED FILAMENT PREHEATING USING HALF-WAVE LAMP CURRENT DETECTION

(75) Inventors: Daisuke Yamahara, Shijonawate (JP); Naoki Komatsu, Kobe (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 324 days.

(21) Appl. No.: 12/606,631

(22) Filed: Oct. 27, 2009

(65) Prior Publication Data

US 2010/0109534 A1 May 6, 2010

(30) Foreign Application Priority Data

Oct. 28, 2008 (JP) ..... 2008-277425

(51) Int. Cl.
*H05B 37/02* (2006.01)

(52) U.S. Cl. ..... 315/224; 315/209 R; 315/307; 315/DIG. 5

(58) Field of Classification Search ..... 315/119, 315/246, 244, 224, 291, 209 R, 227, 307, 315/308, DIG. 5
See application file for complete search history.

(56) References Cited

U.S. PATENT DOCUMENTS 5,808,422 A * 9/1998 Venkitasubrahmanian et al. ..... 315/225
6,140,771 A * 10/2000 Luger et al. ..... 315/101
6,965,204 B2 * 11/2005 Langeslag ..... 315/209 R
7,586,266 B2 * 9/2009 Breuer et al. ..... 315/224

FOREIGN PATENT DOCUMENTS

WO WO03039206 5/2003

* cited by examiner

*Primary Examiner* — Douglas W Owens
*Assistant Examiner* — Amy Yang
(74) *Attorney, Agent, or Firm* — Waddey & Patterson, P.C.; Mark J. Patterson; Gary L. Montle

(57) ABSTRACT

An electronic ballast is provided for controlled preheating of filaments in a discharge lamp. A power converter has a plurality of switching elements and converts DC power from a DC power source into AC power for the lamp. A starting circuit generates a high voltage for starting the lamp. A half-wave discharge detecting circuit detects an absolute value for each polarity peak of a lamp current, calculates an asymmetrical current value from the detected peaks with respect to a predetermined current threshold, and detects a half-wave discharge of the lamp wherein an absolute value of the asymmetrical current value is equal to or more than the current threshold for a predetermined determination time. A control circuit regulates on-times for the switching elements in an filament heating operation wherein the power converting circuit provides a high output frequency for heating each filament of the discharge lamp, and further regulates the on-times to reduce half-wave discharge detected during the filament heating operation.

26 Claims, 17 Drawing Sheets

ELECTRONIC BALLAST WITH CONTROLLED FILAMENT PREHEATING USING HALF-WAVE LAMP CURRENT DETECTION

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: JP2008-277425, filed Oct. 28, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to an electronic ballast for powering a discharge lamp. More particularly, the present invention relates to an electronic ballast with controlled filament preheating using half-wave lamp current detection.

An electronic ballast as known in the art for lighting a hot-cathode type discharge lamp, such as a high-pressure discharge lamp, also referred to as an HID (High-intensity discharge lamp), typically includes a power converting circuit for receiving a DC power input and outputting AC power, and a control circuit for controlling the power converting circuit.

In an example of an electronic ballast of this type as previously known in the art, the control circuit performs a filament heating operation by increasing the output frequency of the power converting circuit to heat each filament of the discharge lamp upon startup of the discharge lamp. This heating operation takes place after a starting operation wherein the output voltage of the power converting circuit is relatively higher, and before the start of steady-state lamp.

The electronic ballast of this example can stabilize lamp discharge after a shift to the steady-state operation and reduce lamp fade-out as compared to the case where filament heating not performed.

Referring to FIG. 24(*a*), a starting period P1 is shown during which a starting operation is performed. When a subsequent filament heating period P2 (during which a filament heating operation is performed) is relatively short as shown, the filament of the discharge lamp is not sufficiently heated before the start of a steady-state period P3. This results in a current being output to the discharge lamp I_lamp (hereinafter referred to as "lamp current") becoming asymmetrical between polarities. When the filament heating operation shifts to the steady-state operation wherein the filament of the discharge lamp is not sufficiently heated, as described above, discharge becomes unstable after a shift to the steady-state operation, thereby possibly causing lamp fade-out. Accordingly, it is necessary to set the filament heating period P2 to be sufficiently long as shown in FIG. 24(*b*). The necessary length of the filament heating period P2 (duration of the filament heating operation) varies for each discharge lamp.

However, where multiple discharge lamps may be connected to the ballast, a particular duration of the filament heating operation that accommodates all discharge lamps is likely to be excessive for some lamps. Because the filament heating operation allows the power converting circuit to output larger power than during steady-state operation, to inhibit a negative effect on the life of the discharge lamp, the duration of the filament heating operation needs to be reduced as much as possible while yet properly heating the filaments.

BRIEF SUMMARY OF THE INVENTION

The present invention was made in consideration of the above problems, with an object to provide an electronic ballast and a lighting fixture in which the output current to the discharge lamp in shifting to steady-state operation can be provided in a positive-negative symmetrical state, while performing a filament heating operation of a suitable but not excessive duration.

According to an aspect of the present invention, an electronic ballast includes a power converting circuit for receiving DC power and outputting AC power, a starting circuit connected between output ends of the power converting circuit together with a discharge lamp so as to generate a high voltage for starting the discharge lamp, and a control circuit for controlling the power converting circuit.

The control circuit at ballast startup first performs a starting operation to allow the discharge lamp to start with a high voltage generated by the starting circuit. The control circuit then shifts to a filament heating operation to make an output frequency of the power converting circuit higher than that in the steady state to heat each filament of the discharge lamp. The control circuit shifts to a steady-state operation to allow the power converting circuit to output AC power for maintaining the lighting of the discharge lamp to the discharge lamp.

The ballast further includes a half-wave discharge detecting circuit for detecting half-wave discharge (rectification) in the discharge lamp. When the half-wave discharge detecting circuit detects half-wave discharge while in the filament heating operation, the control circuit performs a half-wave discharge improving process. The process involves determining peak values for the positive and negative polarities of an output current of the power converting circuit with respect to ground, and then increasing a lower peak value of the two peak values by a predetermined amount to reduce the disparity and thereby resolve the half-wave discharge.

The output current to the discharge lamp in shifting to steady-state operation can be provided in a positive-negative symmetrical state, while performing a filament heating operation of a suitable but not excessive duration for the discharge lamp, in comparison with the case without performing the half-wave discharge improving process.

According to another aspect of the present invention, the power converting circuit includes a step-down chopper circuit for stepping down the received DC power and a full bridge circuit for converting the DC power output from the step-down chopper circuit. The control circuit controls output power of the power converting circuit by a duty ratio associated with turning on/off of at least one switching element in the full bridge circuit.

Alternatively, the power converting circuit may include a half bridge circuit, wherein the control circuit controls output power of the power converting circuit by a duty ratio associated with the turning on/off of a switching element in the half bridge circuit.

According to another aspect of the present invention, the half-wave discharge improving process is realized by superimposing a DC component on the output current of the power converting circuit. Alternatively, the half-wave discharge improving process may be realized by increasing the amplitude of the output current from the power converting circuit.

According to another aspect of the present invention, the control circuit through the filament heating operation maintains a constant adjustment amount of a small peak value obtained by the half-wave discharge improving process.

According to yet another aspect of the present invention, the control circuit sets the adjustment amount of the small peak value obtained by the half-wave discharge improving process to be a half of a difference of peak values between polarities of an output current of the power converting circuit. The adjustment amount is so set by the control circuit when half-wave discharge is detected by the half-wave discharge detecting circuit for the first time after starting the filament heating operation.

According to yet another aspect of the present invention, the control circuit sets the adjustment amount of the small peak value obtained by the half-wave discharge improving process in accordance with the duration of the filament heating operation from detection of half-wave discharge by the half-wave discharge detecting circuit for the first time after starting the filament heating operation. For example, the control circuit may make the adjustment amount larger with an increase in the duration of the filament heating operation from detection of the half-wave discharge by the half-wave discharge detecting circuit for the first time after starting the filament heating operation.

According to another aspect of the present invention, the control circuit changes the adjustment amount of the small peak value obtained by the half-wave discharge improving process as needed in accordance with a difference of peak values between polarities of the output current of the power converting circuit. The control circuit may make the adjustment amount of the small peak value obtained by the half-wave discharge improving process larger with an increase in the difference of peak values between the polarities of the output current of the power converting circuit. The control circuit may further be prevented from increasing the adjustment amount of a small peak value obtained by the half-wave discharge improving process more than a predetermined upper limit value.

According to another aspect of the present invention, the control circuit causes the power converting circuit to stop outputting AC power to the discharge lamp if the half-wave discharge detecting circuit detects half-wave discharge in terminating the filament heating operation. Accordingly it is made possible to prevent an excessive electrical stress from being applied to the discharge lamp resulting from continuously supplying power in a state of having half-wave discharge in the discharge lamp.

According to another aspect of the present invention, the control circuit allows the process to return to the starting operation if the half-wave discharge detecting circuit detects half-wave discharge in terminating the filament heating operation.

According to another aspect of the present invention, if the half-wave discharge detecting circuit detects half-wave discharge in terminating the filament heating operation, the control circuit allows the process to return to the starting operation after causing the power converting circuit to stop outputting AC power to the discharge lamp over a predetermined period of time. Accordingly, half-wave discharge in the discharge lamp is less likely in a subsequent filament heating operation, in comparison with processes where the power converting circuit is not caused to stop outputting AC power to the discharge lamp prior to returning to the starting operation.

According to another aspect of the present invention, the control circuit counts the number of times of returning from the filament heating operation to the starting operation, and causes the power converting circuit to stop outputting AC power when a predetermined upper limit number of times are reached. It is thus made possible to prevent an electrical stress from being wastefully applied to the discharge lamp and circuit components resulting from repeating the starting operation and the filament heating operation without limitation.

According to yet another aspect of the present invention, a fixture main body may be incorporated with various embodiments of the ballast as herein described.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa. With regards to the discharge lamp of this application, "igniting," "starting," and "discharging" of the lamp may be considered synonymous unless otherwise stated.

Figure 1:
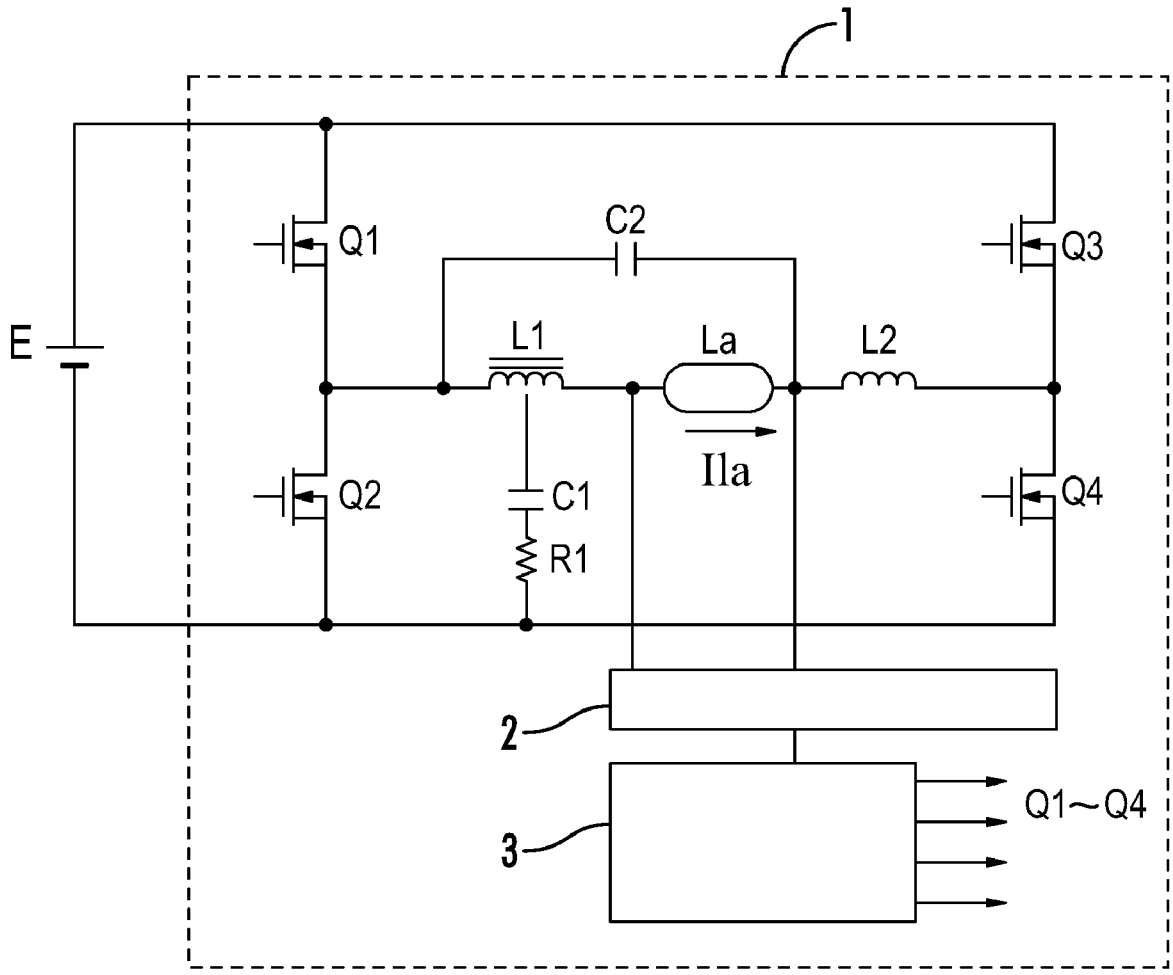
FIG. 1 is a circuit block diagram showing an embodiment of an electronic ballast according to the present invention.

As shown in FIG. 1, an electronic ballast 1 according to the present embodiment is provided to operate a hot-cathode discharge lamp La such as a high-pressure discharge lamp, also called a HID (high-intensity discharge lamp). The ballast includes a power converting circuit for converting DC power inputted from a DC power source E into AC power, which in the embodiment shown includes a full bridge circuit having four switching elements Q1-Q4. A field effect transistor (FET) is used for the switching elements Q1-Q4 in the present embodiment. Switching elements Q1, Q2 are series coupled in parallel with another series circuit of switching elements Q3, Q4 between output ends of the DC power source E.

One of the output ends of the above full bridge circuit, that is a connection point between the switching elements Q1 and Q2, is connected to one end (i.e. one of the filaments) of the discharge lamp La via a first inductor L1. The other output end of the above full bridge circuit, that is a connection point between the switching elements Q3 and Q4, is connected to the other end (i.e. the other filament) of the discharge lamp La via a second inductor L2. The first inductor L1 serves as a so-called autotransformer having a tap which is connected to ground via a series circuit including a first capacitor C1 and a resistor R1. Further connected in parallel with a series circuit formed of the first inductor L1 and the discharge lamp La is a second capacitor C2. That is, each of the inductors L1 and L2 and each of the capacitors C1 and C2 constitute a resonant circuit (referred to as a "load circuit" hereinafter) together with the discharge lamp La.

The present embodiment further includes a half-wave discharge detecting circuit 2 for detecting an power converting circuit output current Ila provided to the discharge lamp La (referred to as a "lamp current" hereinafter) and detecting half-wave discharge (rectification) in the discharge lamp La on the basis of the detected lamp current Ila, and a control circuit 3 for driving on and off each of the switching elements Q1-Q4.

Figure 8:
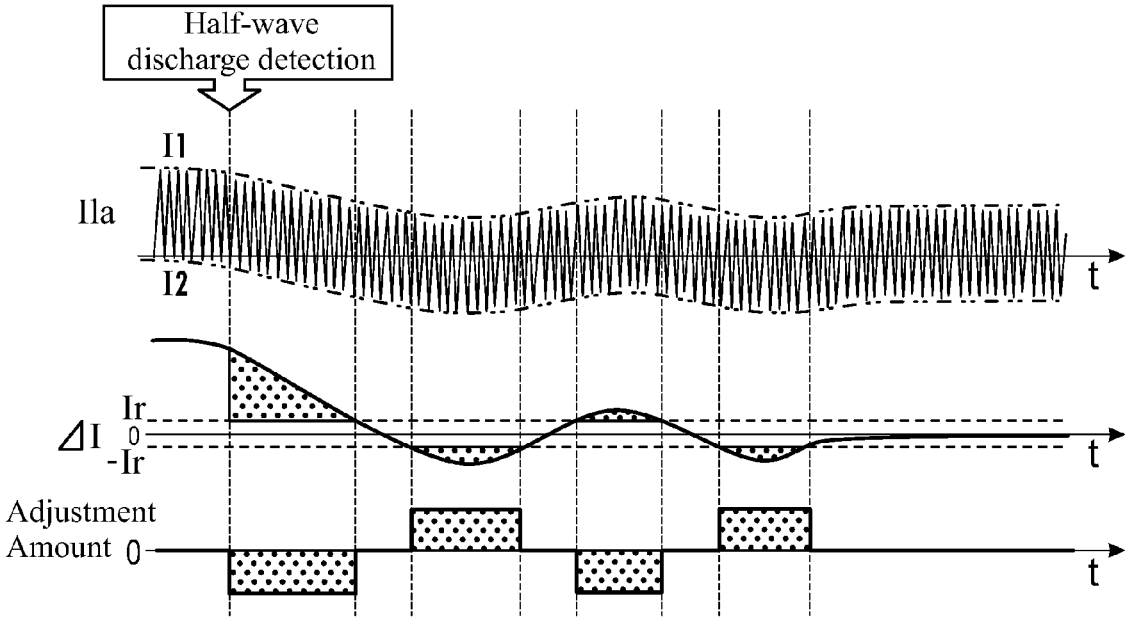
FIG. 8 is an explanatory diagram showing a half-wave discharge improving process according to the embodiment of FIG. 1.

The half-wave discharge detecting circuit 2 detects a peak value (or absolute value) in each polarity of the lamp current Ila so as to calculate a difference ΔI of peak values between the polarities (referred to as an "asymmetrical current value" hereinafter) and compares an absolute value thereof to a predetermined current threshold Ir (refer to FIG. 8). Half-wave discharge (lamp rectification) is detected in a period during which an absolute value of the asymmetrical current value ΔI is maintained to be equal to or more than the current threshold Ir for a predetermined determination time or longer. Otherwise, no half-wave discharge is detected. An output may be provided by the half-wave discharge detecting circuit 2 to the control circuit 3 corresponding to the presence and absence of the detection of half-wave discharge. The aforementioned half-wave discharge detecting circuit 2 can be constructed in accordance with various techniques as well known in the art, and a detailed drawing and explanation thereof will be omitted.

The control circuit 3 drives on and off the switching elements Q1-Q4 so that the switching elements Q1-Q4 diagonally positioned from each other are turned on simultaneously and the switching elements Q1-Q4 serially connected from each other are alternately turned on and off. DC power received from the DC power source E is therefore converted into AC power, and frequency of this AC power corresponds to a frequency in polarity inversion by the above on/off driving (referred to as an "operating frequency").

Figure 2:
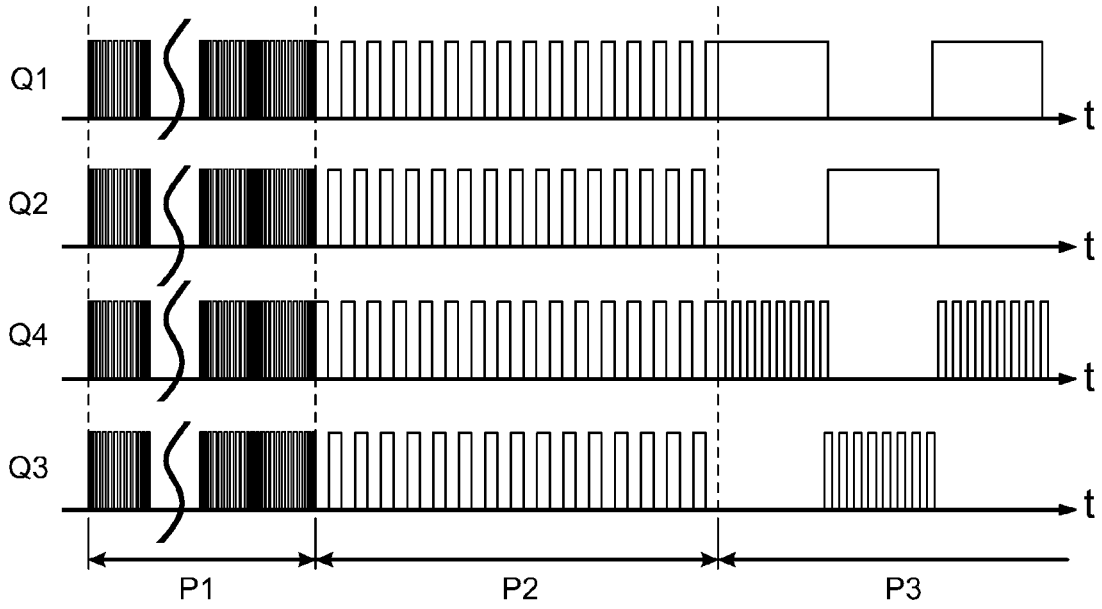
FIG. 2 is an explanatory diagram showing one example of a driving signal provided from a control circuit to each of switching elements in the embodiment of FIG. 1.

Operation of the control circuit 3 of an embodiment of the present invention will be explained below in detail with reference to FIGS. 2 to 4. FIG. 2 shows a driving signal provided to each of the switching elements Q1-Q4, or more specifically a voltage applied between a gate and a source thereof, wherein each of the switching elements Q1-Q4 is turned on in a period during which the above driving signal exhibits an H level and turned off in a period during which the above driving signal exhibits an L level.

When power is supplied (S1), the control circuit 3 begins a starting operation in order to initiate discharge in the discharge lamp La (S2). During a starting control period P1 to perform the starting operation, the control circuit 3 changes an operating frequency periodically in a range from several tens of kHz to several hundreds of kHz. During this starting control period P1, the operating frequency is used at a resonant frequency (or very near to the resonant frequency) for the resonant circuit, the resonant circuit including a primary winding portion of the first inductor L1 serving as an autotransformer, that is, the portion between a connection point of the switching elements Q1 and Q2 and the tap, and the first capacitor C1. A resonant voltage occurring at this time is boosted by the first inductor L1 further serving as the autotransformer, whereby a voltage Vla output to the discharge lamp La (referred to as a "lamp voltage" hereinafter) reaches a voltage required for starting (e.g. 3 to 4 kV), so that the discharge lamp La is started. The first inductor L1 and the first capacitor C1 in this example constitute a starting circuit.

Figure 3:
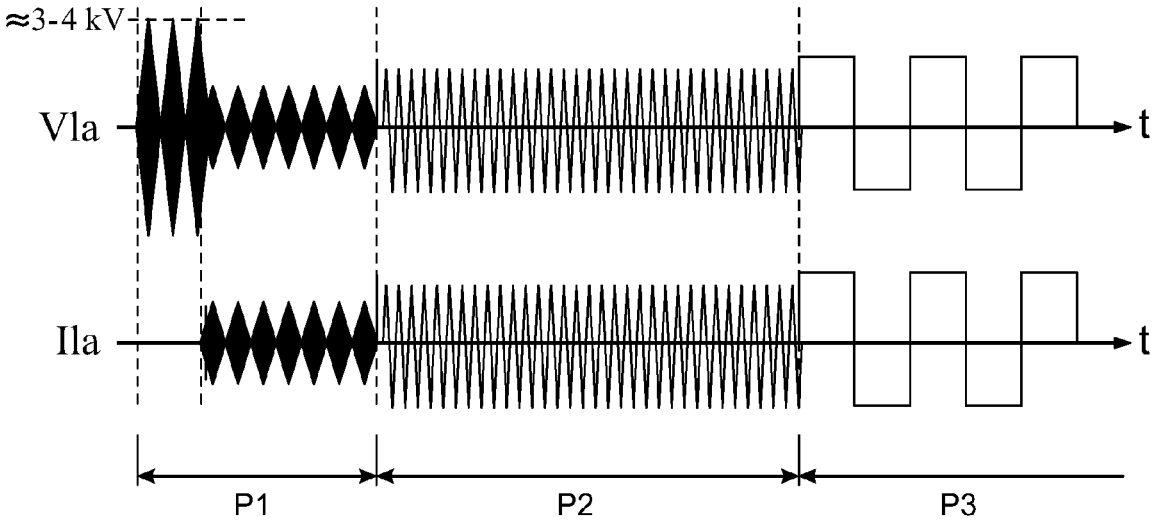
FIG. 3 is an explanatory diagram showing one example of operation in the embodiment of FIG. 1.
Figure 4:
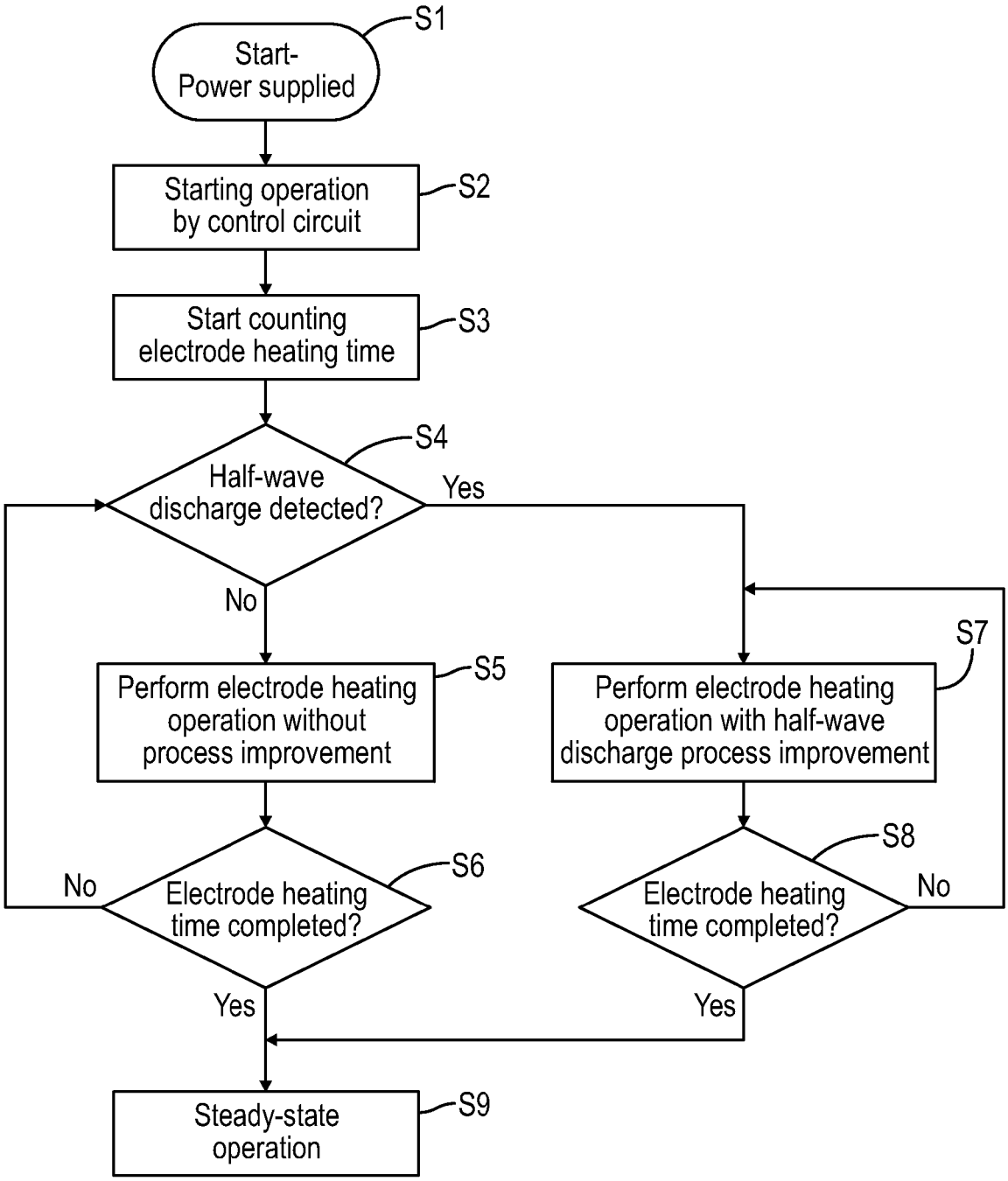
FIG. 4 is a flowchart showing one example of operation in the embodiment of FIG. 1.

Referring to FIG. 3, the discharge lamp La is started and the lamp current Ila starts flowing in a third period of a periodical change of the operating frequency as stated above, and an amplitude of the lamp voltage Vla is decreased due to an impedance change accompanied by the start of the discharge lamp La.

After continuing the above starting operation for a predetermined period of time, the control circuit 3 terminates the starting operation. The process then continues to an filament heating control period P2 to perform an filament heating operation by reducing the operating frequency to a lower frequency (e.g. to about several tens of kHz) than that of the starting operation. The operating frequency during the filament heating operation is still a relatively high frequency which is close to a resonant frequency of the load circuit connected between the output ends of the full bridge circuit, in comparison with an operating frequency during a steady state operation to be described later. In this period P2 each filament of the discharge lamp La is heated.

When the filament heating period P2 has begun, the control circuit 3 starts counting a predetermined filament heating time during which the filament heating operation should be maintained (S3), followed by referring to an output from the half-wave discharge detecting circuit 2 (S4). If no half-wave discharge is detected, the filament heating operation is performed over a predetermined period of time (S5), followed by determining whether or not counting the filament heating time is completed (S6), and returning to step S4 if the count indicates that the filament heating time is incomplete. Reference to an output from the half-wave discharge detecting circuit 2 is periodically made at every predetermined time mentioned above until a half-wave discharge is detected or the filament heating time is complete.

In contrast, if the half-wave discharge is detected in step S4, a filament heating operation including a half-wave discharge improving process for resolving half-wave discharge in an early stage is performed (S7), followed by determining whether or not counting the filament heating time is completed (S8) and returning to step S7 when the filament heating time has not been completed.

When the filament heating time is counted as being completed in either of step S6 or step S8, the process proceeds to steady state operation (S9).

During a steady state control period P3 to perform the steady state operation, the control circuit 3 supplies to the discharge lamp La rectangular wave AC power for maintaining lighting of the discharge lamp La by reducing the operating frequency to be much lower (e.g. several hundreds Hz) than that during the filament heating operation. During the steady state operation, the control circuit 3 also performs PWM control of the power supplied to the discharge lamp La by turning on and off each of the switching elements Q3 and Q4 in one of the series circuit with a predetermined duty ratio without constantly turning them on even in a period during which the diagonally positioned switching elements Q1 and Q2 are turned on.

An embodiment of the half-wave discharge improving process as shown in step S7 may now be explained in further detail. In a period during which the half-wave discharge detecting circuit 2 detects half-wave discharge, the control circuit 3 receives from the half-wave discharge detecting circuit 2 information regarding a peak value of the lamp current Ila in each of the positive and negative polarities with respect to ground (i.e. asymmetrical current value ΔI). For a pair of the switching elements Q1-Q4 diagonally positioned from each other and having a polarity with a lower peak of the lamp current Ila with respect to the opposite pair of diagonally positioned switching elements, an on-time is extended by the control circuit 3 by a predetermined adjustment amount. The control circuit 3 further shortens the on-time by the same adjustment amount in the other pair.

Figure 5:
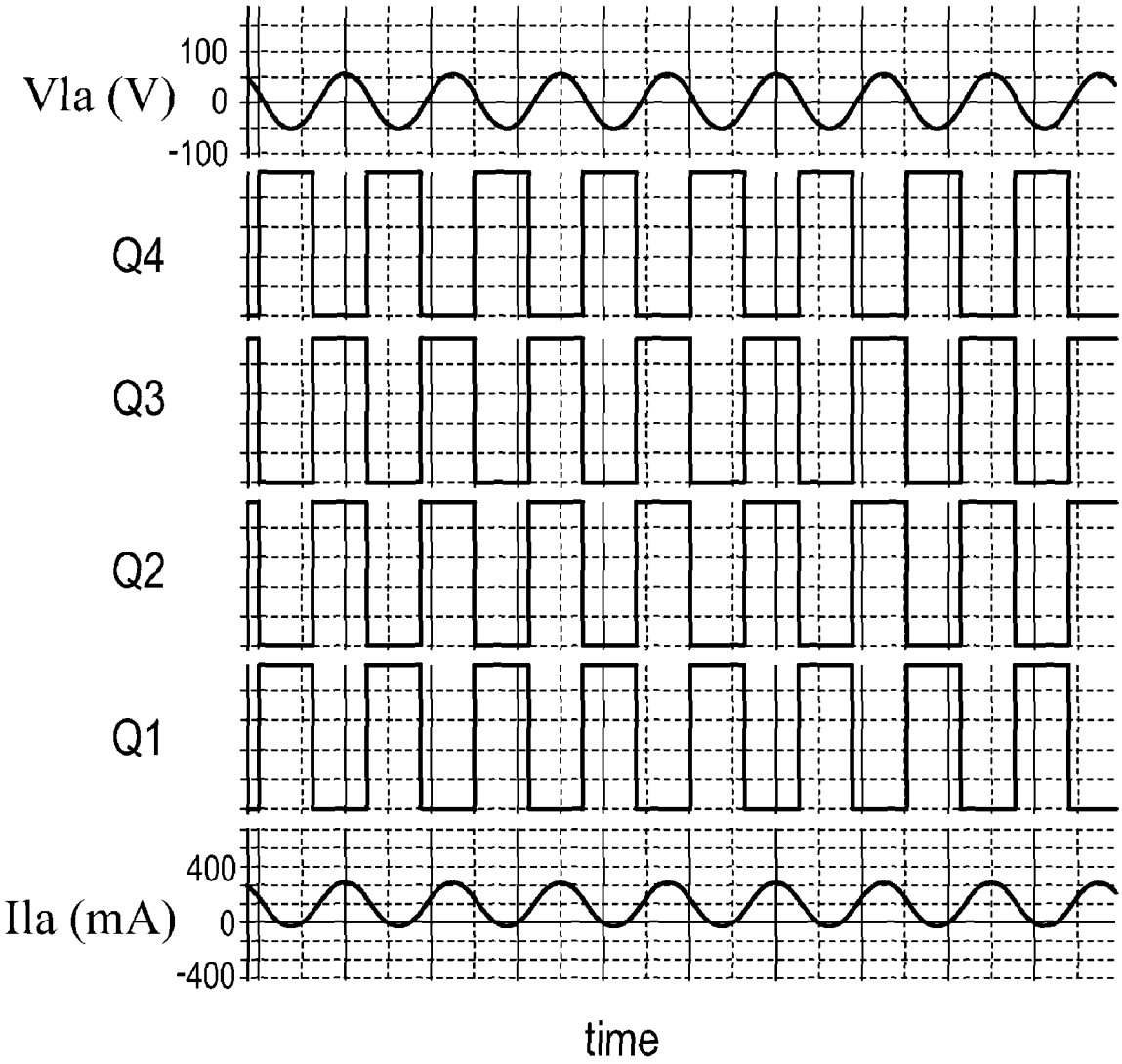
FIG. 5 is an explanatory diagram showing waveforms of a lamp voltage, a driving signal provided from the control circuit to each of the switching elements and a lamp current in an adjustment amount of 0.
Figure 6:
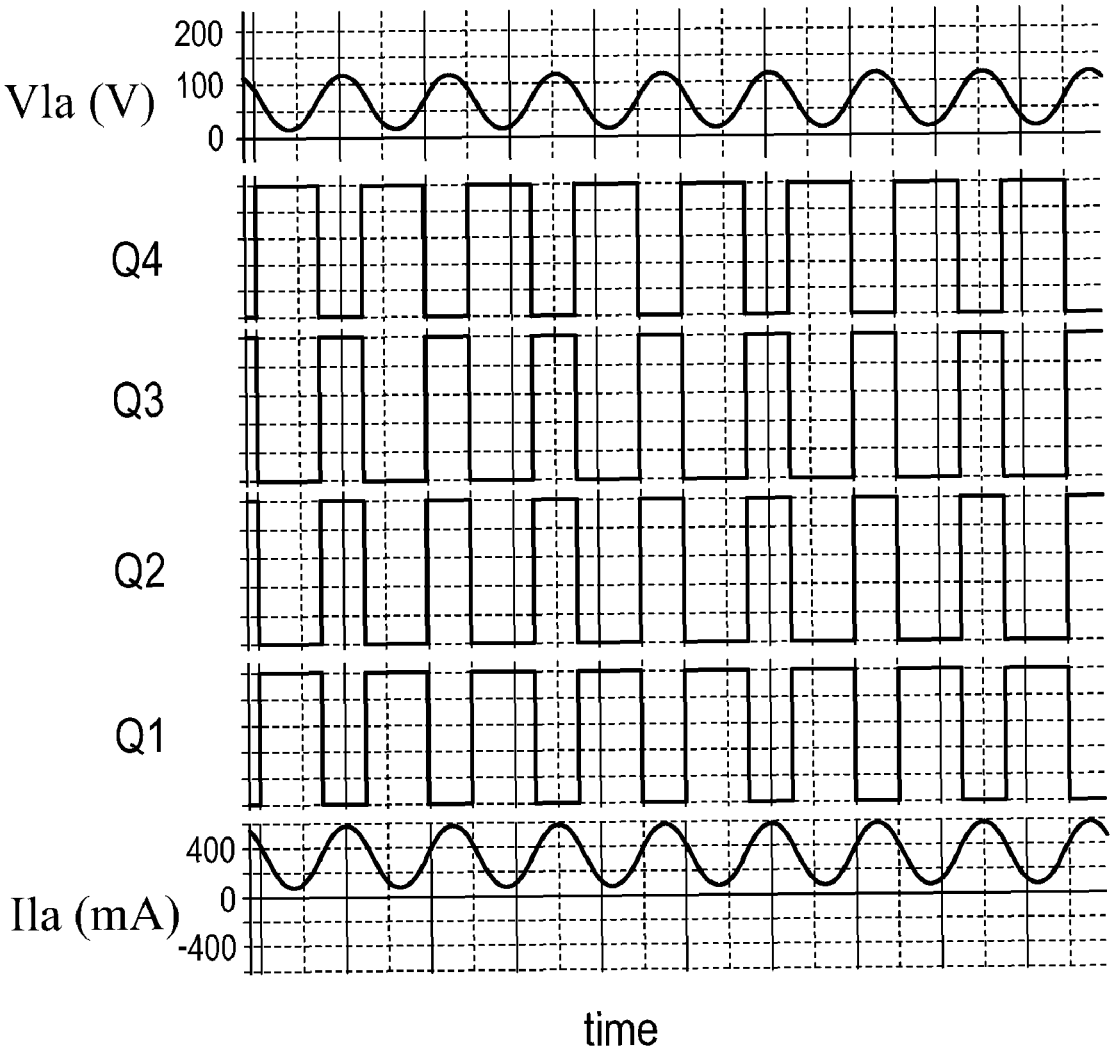
FIG. 6 is an explanatory diagram showing waveforms of a lamp voltage, a driving signal provided from the control circuit to each of the switching elements and a lamp current in a positive adjustment amount.

Also, in a period during which the half-wave discharge detecting circuit 2 does not detect half-wave discharge, the above adjustment amounts are set to 0, which means an on-time duty ratio of 0.5 is set for each of the switching elements Q1-Q4. That is, in the above half-wave discharge improving process, the operating frequency as a whole is unchanged regardless of the presence or absence of half-wave discharge detected by the half-wave discharge detecting circuit 2. If a value other than 0 is set for the adjustment amount in the above half-wave discharge improving process, a DC current with a magnitude corresponding to the adjustment amount and in a direction corresponding to the switching elements Q1-Q4 with extended on-time is superimposed on the lamp current Ila, and the magnitude of this DC component is made larger with an increase in absolute value of the adjustment amount. For example, if a direction extending from left to right as shown in FIG. 1 is assumed to be a positive direction in each of the lamp current Ila and the lamp voltage Vla, no DC component is observed in both the lamp voltage Vla and the lamp current Ila when the adjustment amount is 0, that is, when the on-time is common for each of the switching elements Q1-Q4 as shown in FIG. 5, whereas a positive DC component with a magnitude corresponding to an adjustment amount is observed in each of the lamp voltage Vla and the lamp current Ila when longer on-time (with on-time duty ratio of 0.6 for example) is set for the switching elements Q1 and Q4 each of which corresponds to a positive filament as shown in FIG. 6.

Figure 7:
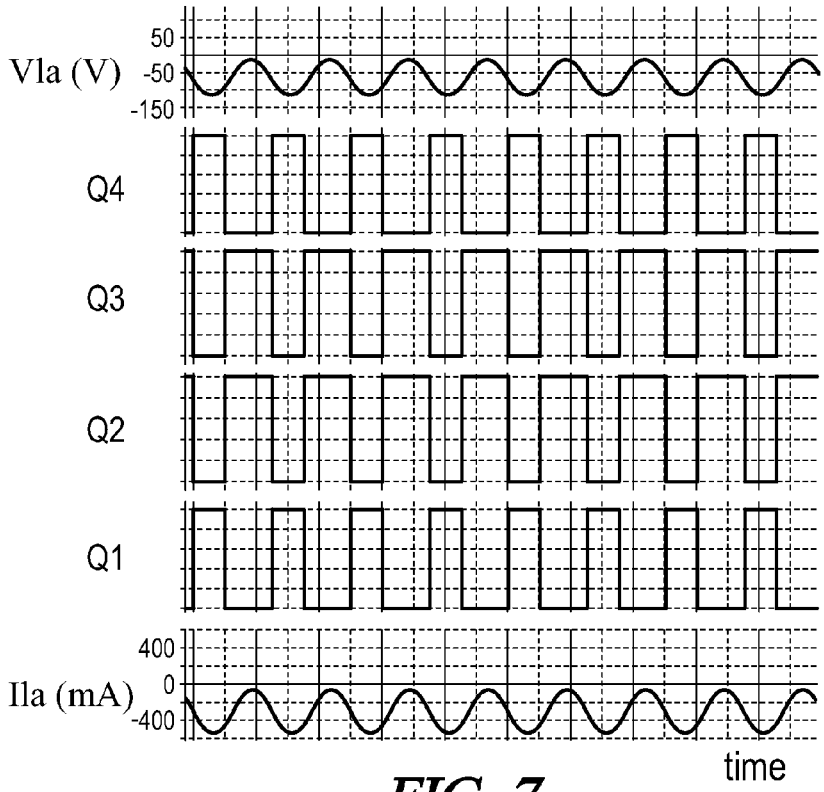
FIG. 7 is an explanatory diagram showing waveforms of a lamp voltage, a driving signal provided from the control circuit to each of the switching elements and a lamp current in a negative adjustment amount.

On the other hand, a negative DC component with a magnitude corresponding to an adjustment amount is observed in each of the lamp voltage Vla and the lamp current Ila when longer on-time (with on-time duty ratio of 0.6 for example) is set for the switching elements Q2 and Q3 each of which corresponds to a negative polarity as shown in FIG. 7.

Detection of half-wave discharge similar to step S4 and the above changes in the adjustment amount are carried out as needed until the filament heating operation is finished by completion of counting the filament heating time in step S8. That is, in the case where half-wave discharge is not later detected after an initial detection of the half-wave discharge and applied adjustment, the adjustment amount returns to 0. In the case where the half-wave discharge is detected again thereafter, the adjustment amount is set to any values corresponding to the asymmetrical current value ΔI, other than 0.

In the following explanation, and with reference generally to FIGS. 5-8, a peak value (or absolute value) in a positive direction of the lamp current Ila is defined as Ia, a peak value (or absolute value) in a negative direction thereof is defined as Ib, and the asymmetrical current value ΔI is defined as ΔI=Ia−

Ib. That is, the asymmetrical current value ΔI is a positive value when a positive DC component occurs in the lamp current Ila, and the asymmetrical current value ΔI is a negative value when a negative DC component occurs in the lamp current Ila. For the adjustment amount, a direction to generate a positive DC component is defined as a positive value and a direction to generate a negative DC component is defined as a negative value. Therefore, the asymmetrical current ΔI and the adjustment amount are inversely coded from each other as shown in FIG. 8 in the above half-wave discharge improving process. An absolute value of the adjustment amount in a period during which half-wave discharge is detected is set so that, for example, the magnitude of a DC component generated in the lamp current Ila becomes a half of an absolute value of the asymmetrical current ΔI obtained when the half-wave discharge is detected for the first time. The absolute value of the adjustment amount in a period during which half-wave discharge is detected is further set to be constant during the filament heating operation in the present embodiment.

Note that to avoid the adjustment amount being excessively increased, the above absolute value of the adjustment amount may also be set so that the magnitude of the DC component generated in the lamp current Ila becomes slightly smaller than a half of the absolute value of the asymmetrical current value ΔI obtained when the half-wave discharge is detected for the first time.

According to the above configuration, the half-wave discharge improving process makes it easier to heat one of the filaments with a lower temperature corresponding to a polarity with a smaller amount of the lamp current Ila in the discharge lamp La. Lamp flickering and fade out after proceeding to steady state operation may thereby be suppressed by providing an output current to the discharge lamp in a positive-negative symmetrical state in proceeding to the steady state operation while desirably keeping the duration of the filament heating operation relatively short.

Figure 9:
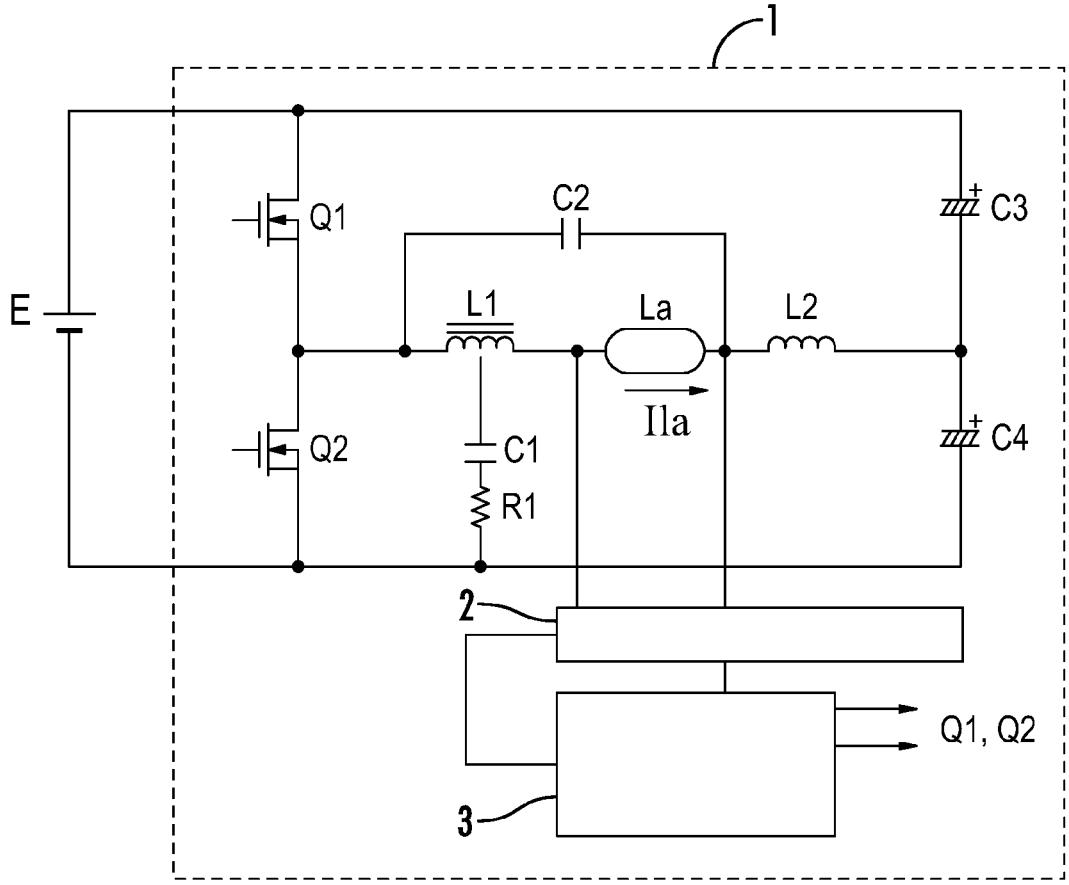
FIG. 9 is a circuit block diagram showing another embodiment of the present invention.
Figure 10:
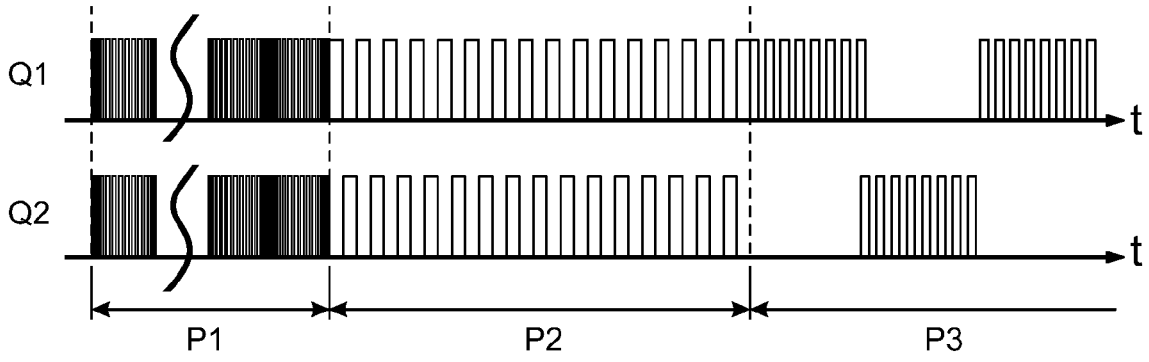
FIG. 10 is an explanatory diagram showing one example of a driving signal provided from the control circuit to each of the switching elements in the embodiment of FIG. 9.

With reference now to FIG. 9, in another embodiment of a circuit configuration in accordance with the present invention, the respective switching elements Q3 and Q4 which constitute one of the series circuits are replaced with capacitors C3 and C4 respectively, which may along with switching elements Q1 and Q2 be employed in place of the full bridge circuit as shown in FIG. 1. In this case, as shown in FIG. 10, the starting period P1 and the filament heating period P2 are realized in common with those of the example in FIG. 1 in terms of driving on and off of the two switching elements Q1 and Q2 serially connected from each other. In addition, PWM control is performed in the steady state period P3 in which output power to the discharge lamp La is adjusted in association with a duty ratio obtained in turning on and off the switching elements Q1 and Q2, which should be turned on in a period during which polarity is not inverted.

Figure 11:
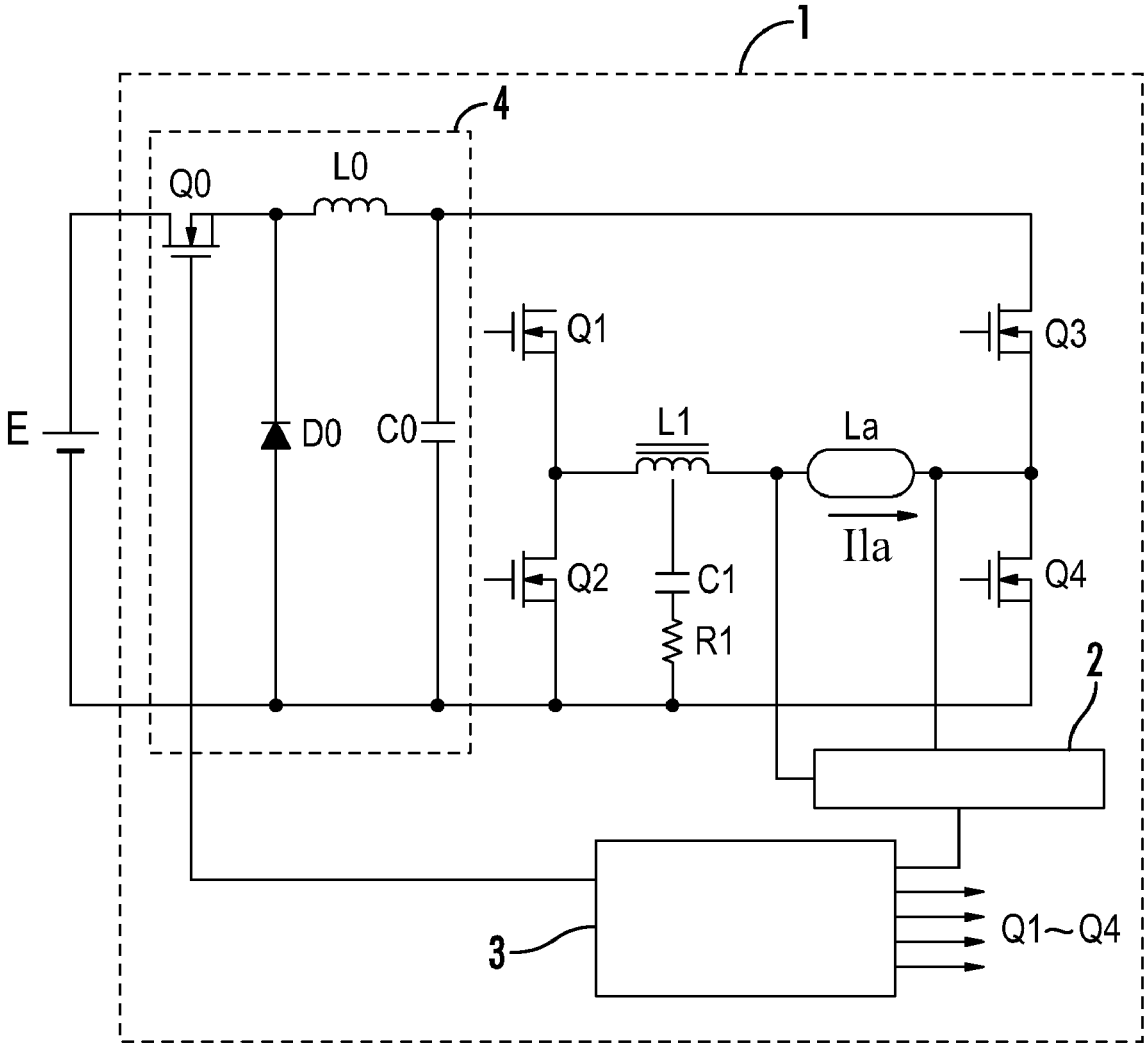
FIG. 11 is a circuit block diagram showing another embodiment according to the present invention.

Alternatively, a step-down chopper circuit 4 as shown in FIG. 11 may also be arranged to step down an output voltage of a DC power source E which is provided to a full bridge circuit. In this case the full bridge circuit, including four switching elements Q1-Q4, and the above step-down chopper circuit 4 together constitute a power converting circuit. In the example of FIG. 11, the step-down chopper circuit 4 includes a switching element Q0 with one terminal end connected to an output end of the DC power source E on a high voltage side and the other terminal end connected to an input end of the full bridge circuit via an inductor L0, a diode D0 with a cathode connected to a connection point of the switching element Q0 and the inductor L0 and an anode connected to the ground, and a capacitor C0 connected between input ends of the full bridge circuit, that is, between output ends of the step-down chopper circuit 4. Also omitted in the example of FIG. 11 are the second inductor L2 and the second capacitor C2 in the load circuit.

Figure 12:
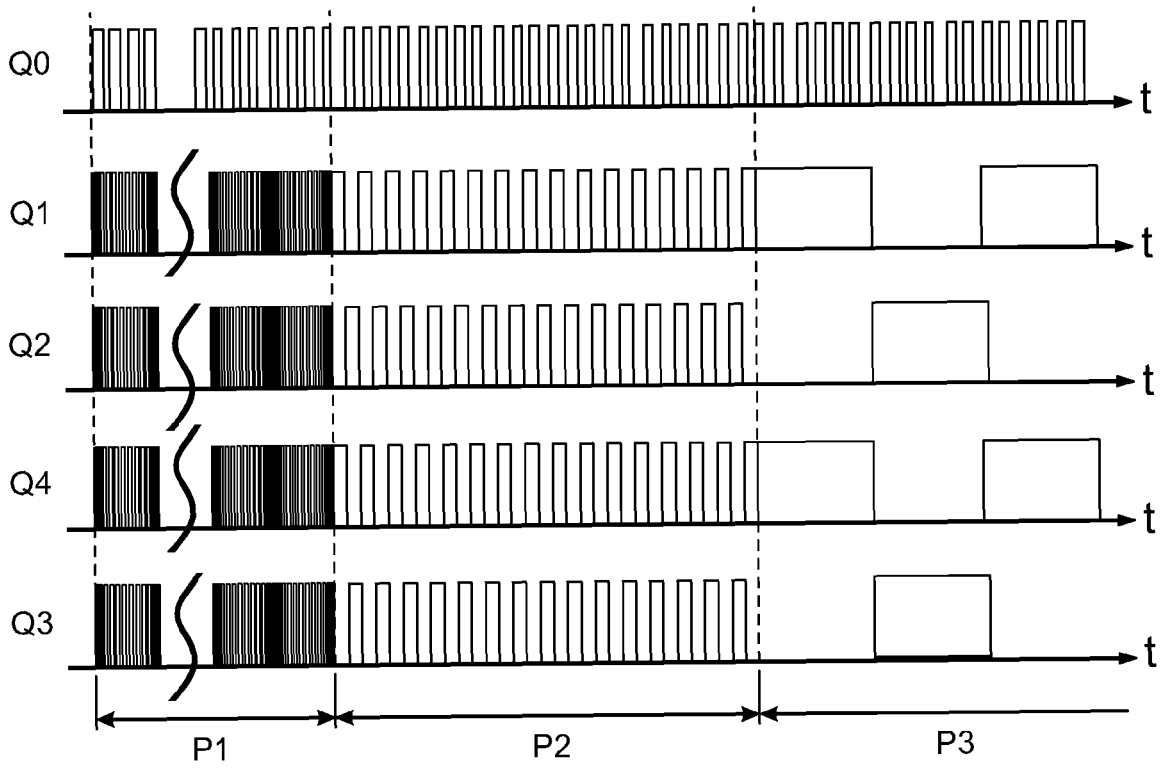
FIG. 12 is an explanatory diagram showing one example of a driving signal provided from the control circuit to each of the switching elements in the embodiment of FIG. 11.

As shown in FIG. 12, the control circuit 3 controls power supplied to the discharge lamp La by controlling a duty ratio for the switching element Q0 in the step-down chopper circuit Q4, which means no PWM control is performed by turning on and off the switching elements Q1-Q4 in the full bridge circuit even in the steady state period P3.

A pulse generating circuit (not shown) may also be arranged as a starting circuit to generate a high voltage pulse for starting the discharge lamp La during the starting operation. The aforementioned pulse generating circuit can be realized by well known techniques, so a detailed drawing and explanation thereof may be omitted.

In place of setting a duration for the filament heating operation to be constant, the filament heating operation may also be continued until at least no half-wave discharge is detected by the half-wave discharge detecting circuit 2. That is, a step is arranged to refer to an output of the half-wave discharge detecting circuit 2 prior to step S8 for determining completion of counting the filament heating operation, and the process proceeds to step S8 when no half-wave discharge is detected in this step, whereas the process continues the filament heating operation without proceeding to step S8 when the half-wave discharge is detected.

Figure 13:
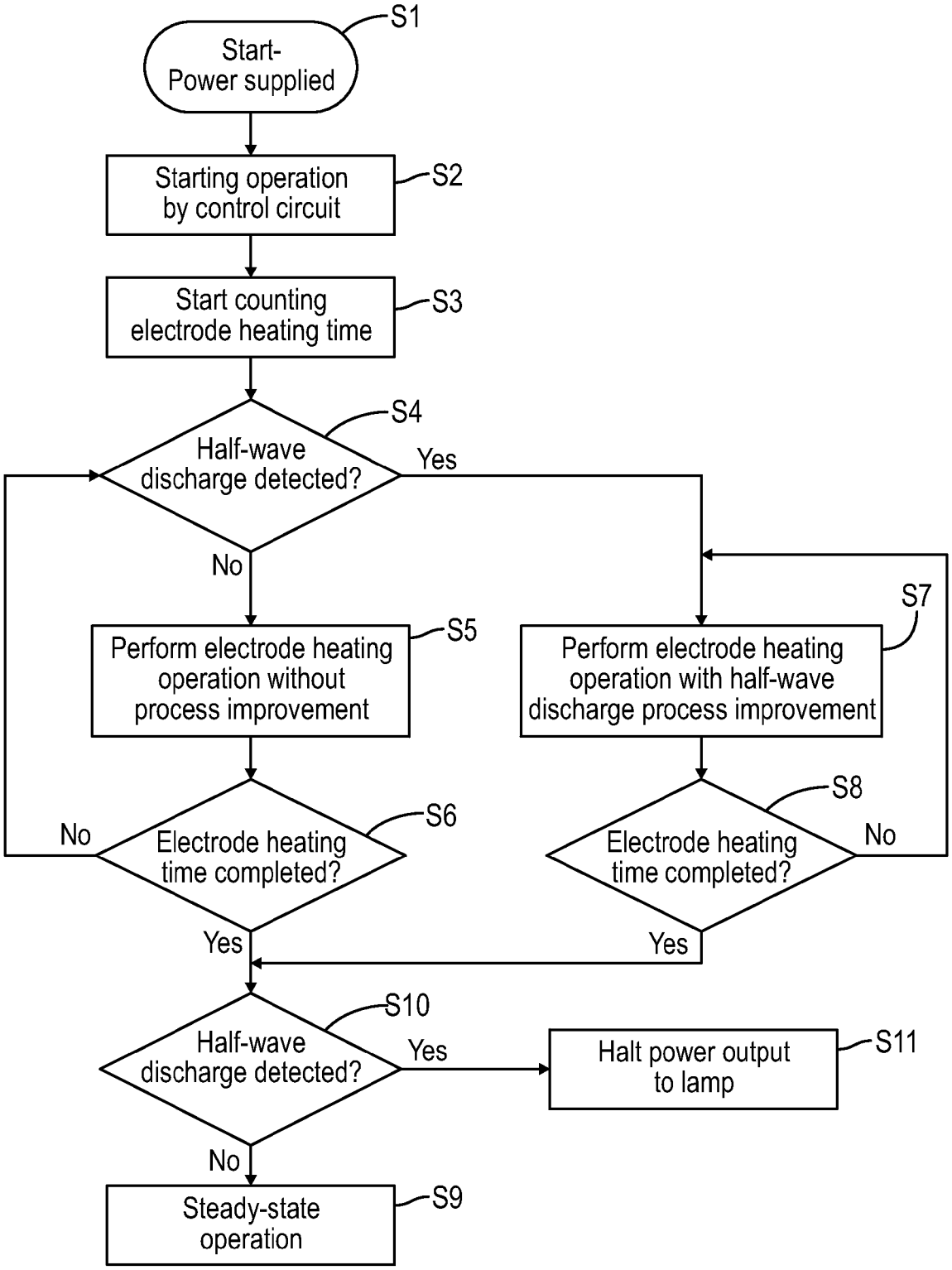
FIG. 13 is a flowchart showing an alternative operation according to the embodiment of FIG. 11.

In addition, and as shown in FIG. 13, the control circuit 3 may also refer to an output of the half-wave discharge detecting circuit 2 after terminating the filament heating operation and before starting the steady state operation (S10). If no half-wave discharge is detected, the process proceeds to the steady state operation in step S9 without making any changes. If a half-wave discharge is detected, power supplied to the discharge lamp La is stopped by, for example, turning off each of the switching elements Q1-Q4 (S11). Employing this configuration will make it possible to prevent an excessive electrical stress from being applied to the discharge lamp La as a result of performing the steady state operation while a half-wave discharge is present.

Figure 14:
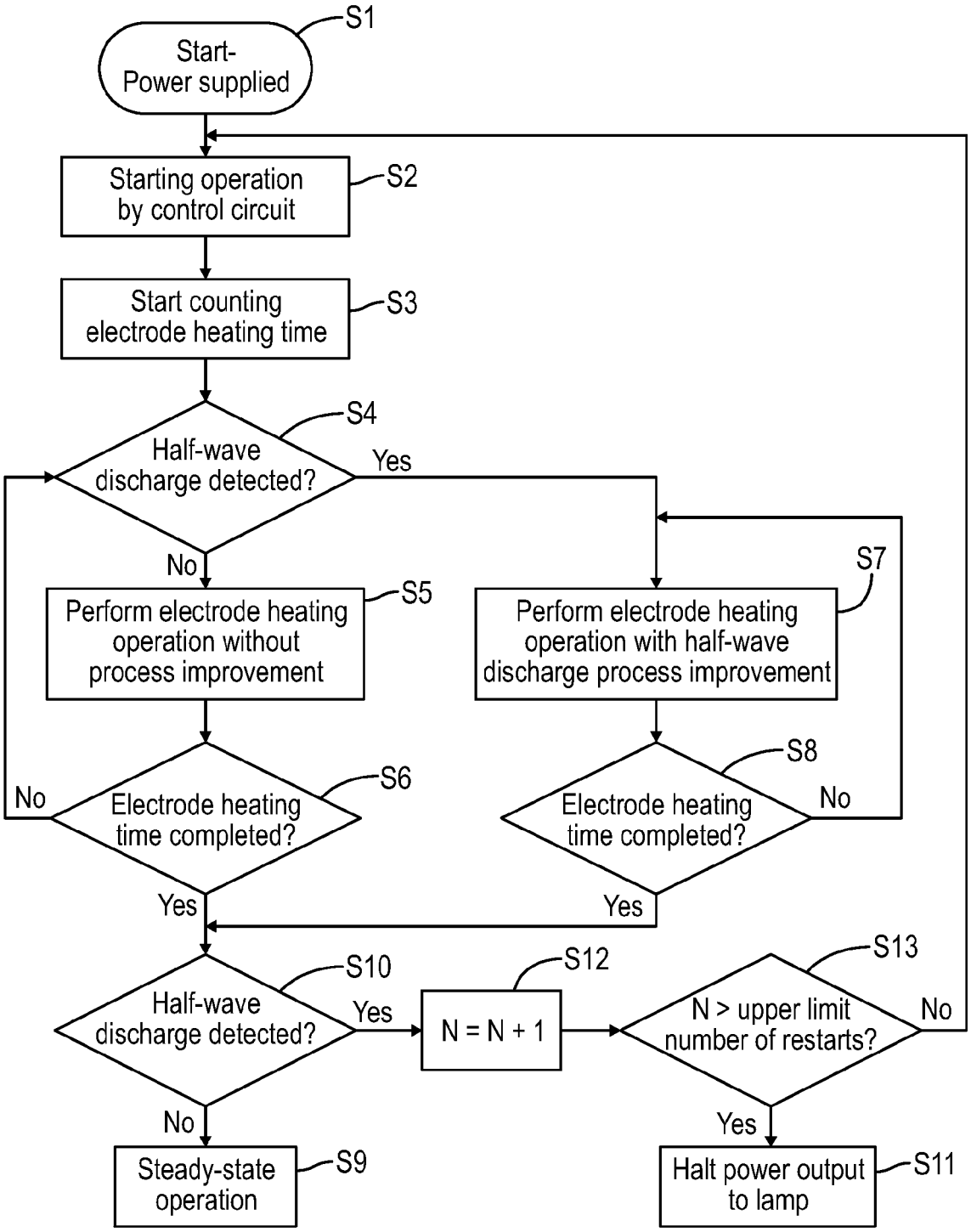
FIG. 14 is a flowchart showing another alternative operation according to the embodiment of FIG. 11.

Furthermore, as shown in FIG. 14, instead of immediately removing power supplied to the discharge lamp La by the control circuit 3 in the case where the half-wave discharge is detected in step S10, it may also be possible to allow the process to return to the starting operation in step S2. This configuration will make it possible to improve starting ability in comparison with the example of FIG. 13. In addition, in the example of FIG. 14, the number of times of returning N to step S2 (referred to as a "number of times of restarting" hereinafter) is further counted in step S12 and compared to a predetermined upper limit number of times in step S13, if the number of times of restarting N exceeds the upper limit number of times, the process does not return to step S2 but proceeds to step S11 to stop power supplied to the discharge lamp La. That is, the process does not return to the starting operation more in the case of than the upper limit number of times or more, thereby making it possible to prevent an unnecessary electrical stress from being applied to circuit components resulting from repeating the above loop without limitation.

Figure 15:
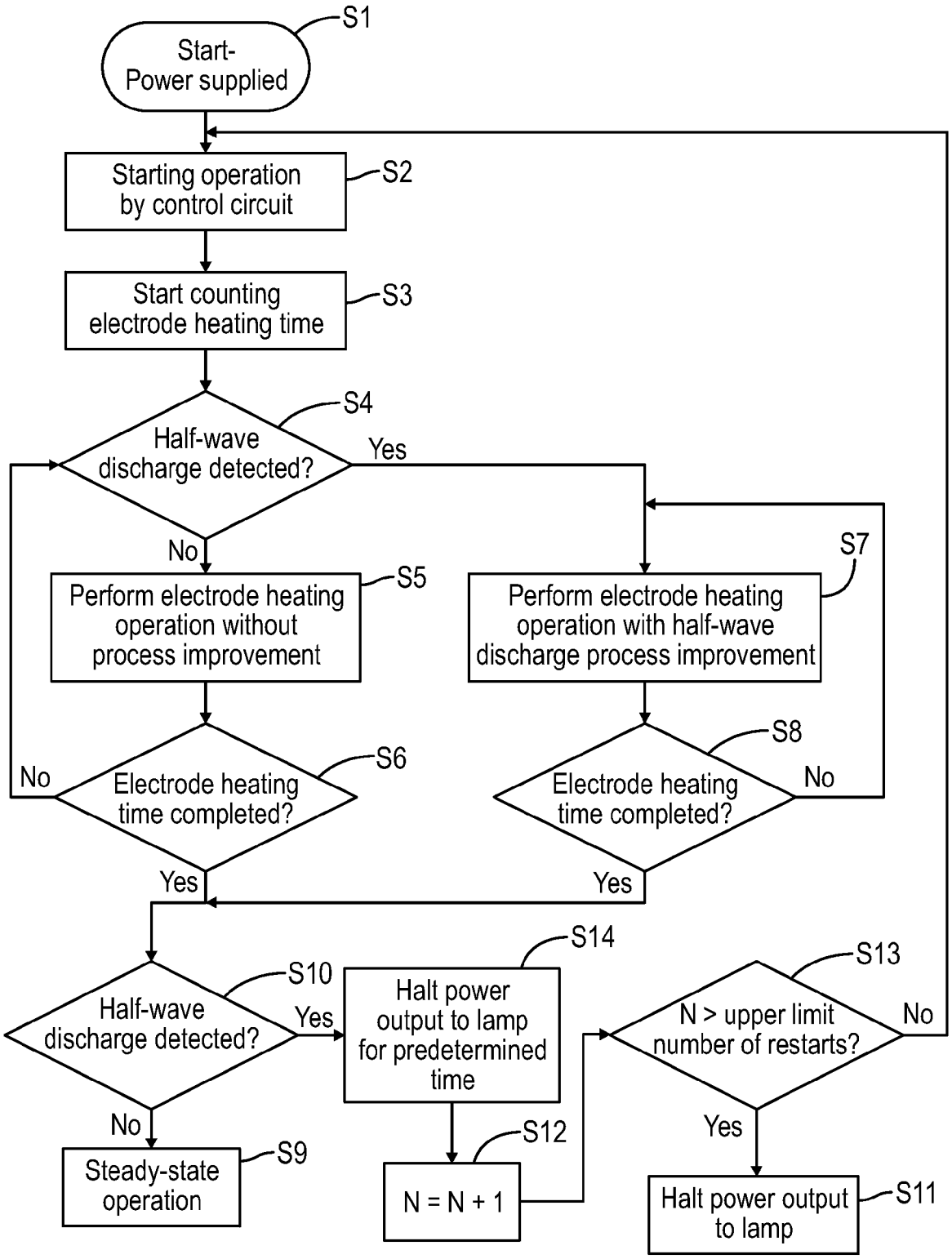
FIG. 15 is a flowchart showing another alternative operation according to the embodiment of FIG. 11.

In addition, as shown in FIG. 15, in the case where half-wave discharge is detected in step S10, the control circuit 3 may also halt power supplied to the discharge lamp La over a predetermined period of time prior to returning to step S2 by, for example, turning off each of the switching elements Q1-Q4 (S14). By employing this configuration, gas in the discharge lamp La is stabilized prior to restart of the starting operation, and thus the half-wave discharge is resolved in a relatively short period of time in a subsequent filament heating operation.

Furthermore, the method to detect the half-wave discharge by the half-wave discharge detecting circuit 2 is not limited to one based on the difference of peak values between polarities as stated above, and may also be realized by, for example, comparing a smaller peak value out of peak values of both polarities of the lamp current Ila (referred to as a "small peak value" hereinafter) to a predetermined current threshold so as to detect the half-wave discharge in a period during which the small peak value is maintained to be less than the current threshold for the predetermined determination time or longer, and prevent detection of the half-wave discharge in a period other than the above period. The current threshold used in this case is assumed to correspond to a minimum value required for the lamp current Ila to sufficiently increase the temperature of filaments of the discharge lamp La in the filament heating time under an assumed environment (referred to as a "minimum current value" hereinafter).

Figure 16:
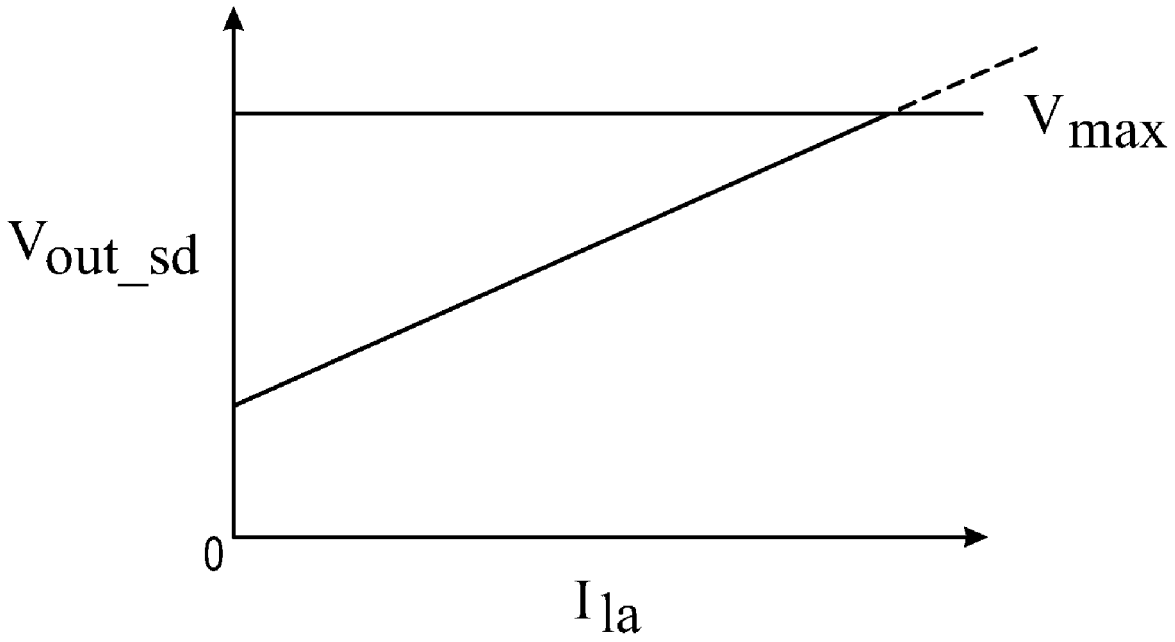
FIG. 16 is an explanatory diagram showing a relationship between an output voltage of a step-down chopper circuit and an amplitude of a lamp current.

The half-wave discharge improving process may also be realized by making the amplitude of the lamp current Ila larger in place of generating a DC component in the lamp current Ila as stated above. For example, the amplitude of the lamp current Ila is increased only in a period during which the half-wave discharge detecting circuit 2 detects the half-wave discharge. An amount increased in the amplitude of the lamp current Ila in the half-wave discharge improving process (simply referred to as "increased amplitude" hereinafter) is set to, for example, a half of the absolute value of the asymmetrical current value AI obtained when the half-wave discharge is detected for the first time. Also considered as a method to make the amplitude of the lamp current Ila larger is, in addition to changing the operating frequency, changing an output voltage Vout_sd of the step-down chopper circuit 4 in the example of FIG. 11. The relationship between the output voltage of the step-down chopper circuit 4 and the amplitude of the lamp current is as shown in FIG. 16.

Figure 17:
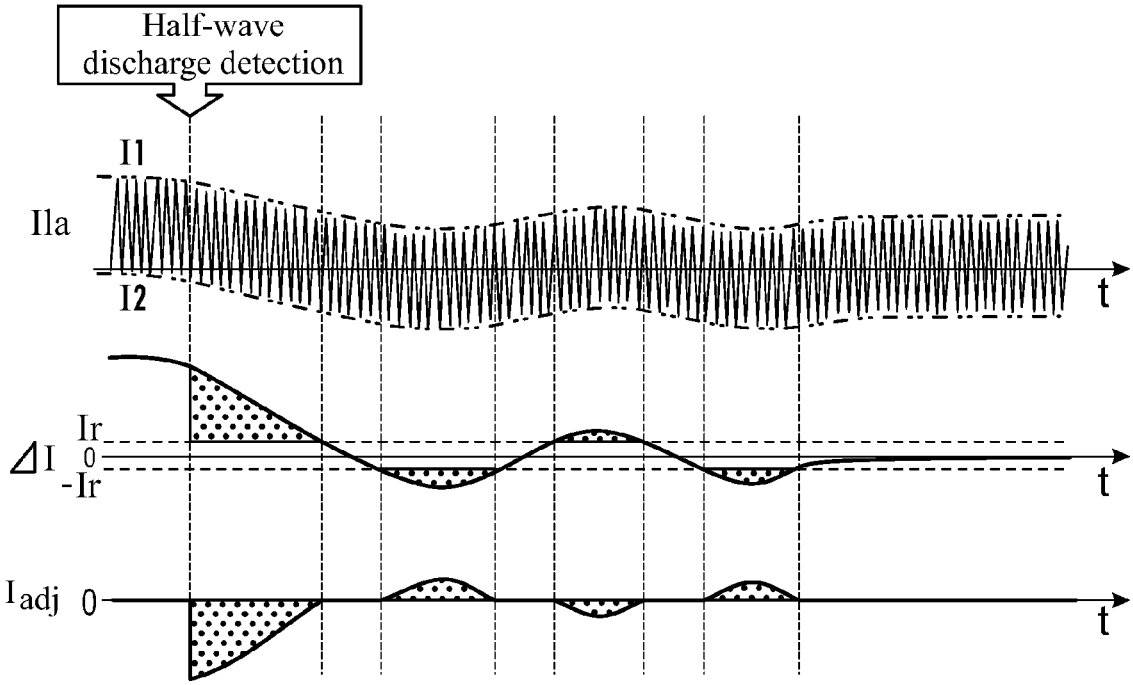
FIG. 17 is an explanatory diagram showing a modified example of the half-wave discharge lamp improving process according to the embodiment of FIG. 11.
Figure 18:
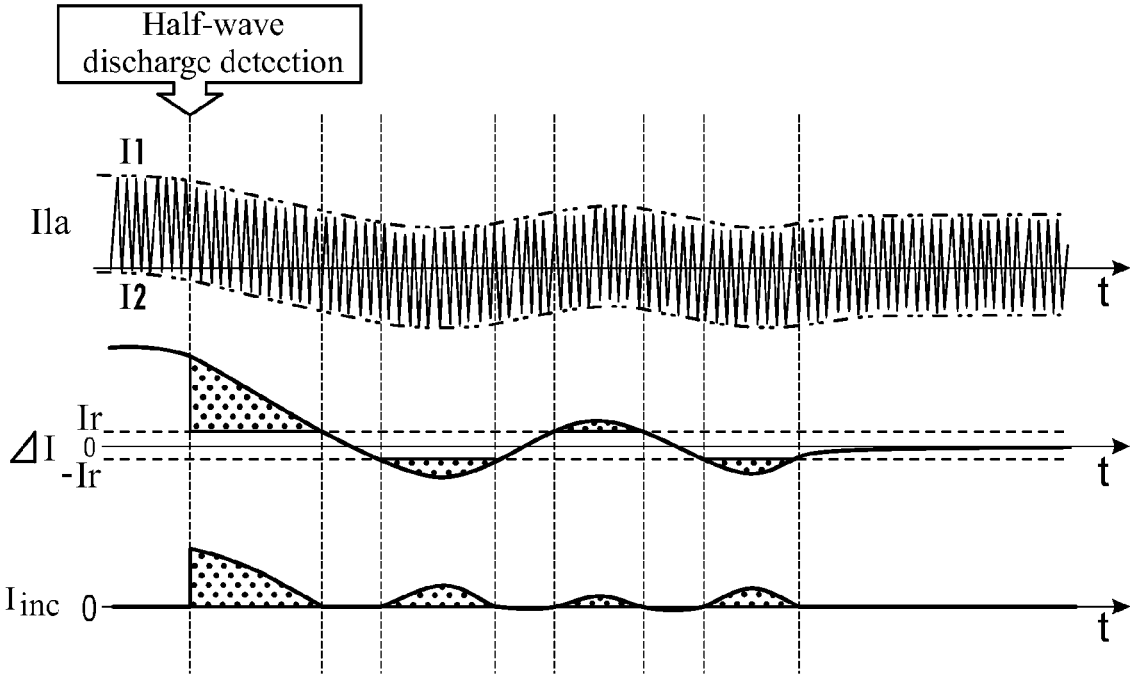
FIG. 18 is an explanatory diagram showing further another modified example of the half-wave discharge lamp improving process according to the embodiment of FIG. 11.

Furthermore, the half-wave discharge improving process may also be realized by setting a larger value for the absolute value of the adjustment amount Iadj and the increased amplitude Iinc with an increase in the absolute value of the asymmetrical current value ΔI as shown in FIGS. 17 and 18 in place of setting them to be constant through the filament heating operation. For example, the magnitude of the DC component superimposed on the lamp current Ila in accordance with an adjustment amount and the increase of the amplitude are set to a half of the absolute value of the asymmetrical current value ΔI.

The absolute value of the adjustment amount Iadj and the increased amplitude Iinc may also be determined by a feedback control in which a small peak value is used as a lower limit current value. Furthermore, in the case where the adjustment amount per unit time and an adjustment period of the increased amplitude are constant, the process may also be realized without proceeding to step S8 until a difference between the small peak value and a lower limit current value becomes a predetermined threshold or less, that is, preventing the filament heating operation from terminating even if counting the filament heating time is completed.

Figure 19:
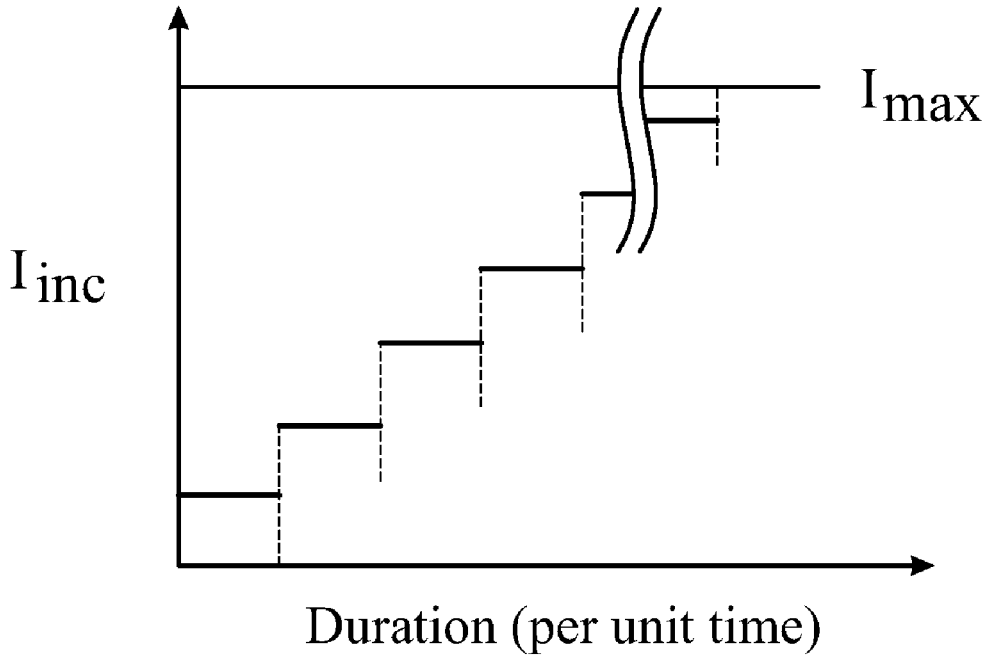
FIG. 19 is an explanatory diagram showing a relationship between the duration after starting an filament heating operation and an increased amplitude in a still further another modified example of the half-wave discharge improving process according to the embodiment of FIG. 11.
Figure 20:
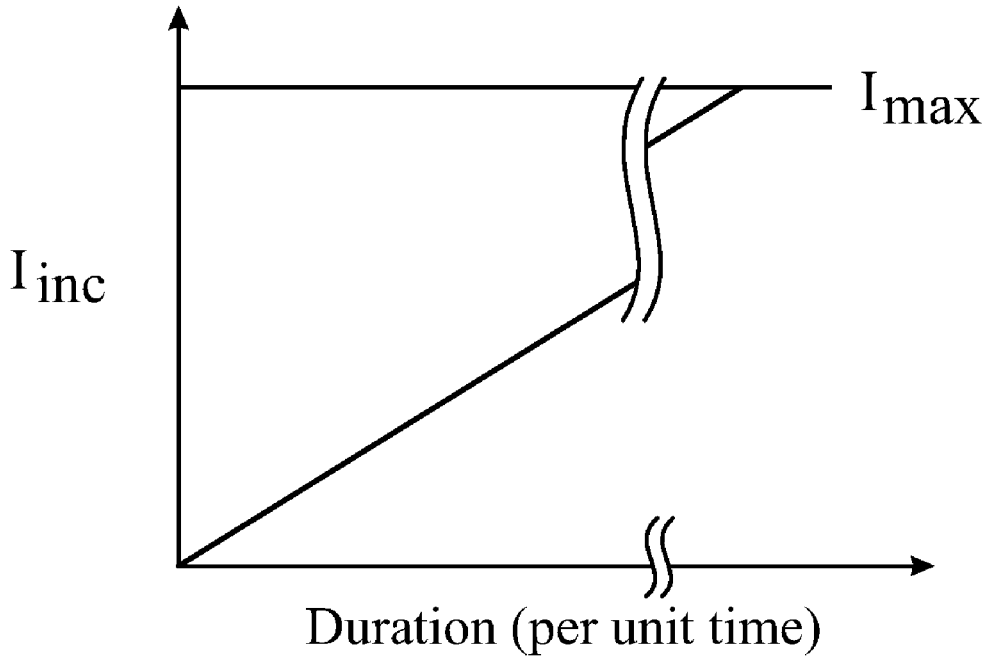
FIG. 20 is an explanatory diagram showing a relationship between the duration after starting the filament heating operation and the increased amplitude in another modified example of the half-wave discharge improving process according to the embodiment of FIG. 11.

The absolute value of the adjustment amount and the increased amplitude Iinc in the half-wave discharge improving process may also be gradually increased in accordance with the duration of the filament heating operation from detection of the half-wave discharge by the half-wave discharge detecting circuit 2 for the first time after starting the filament heating operation. This increase may be realized in a stepwise manner with respect to the above duration as shown in FIG. 19 or in a continuous linear state with respect to the above duration as shown in FIG. 20. Vertical axes showing the increased amplitude in FIGS. 19 and 20 can be similarly used to show the absolute value of the adjustment amount.

It is also desirable for the control circuit 3 to increase the absolute value of the adjustment amount Iadj and the increased amplitude Iinc in a range less than a predetermined upper limit value in the case where the absolute value of the adjustment amount Iadj and the increased amplitude Iinc are changed as needed as stated above. The above upper limit value may be appropriately determined in accordance with a rated current value of the circuit components and the discharge lamp La.

Figure 21:
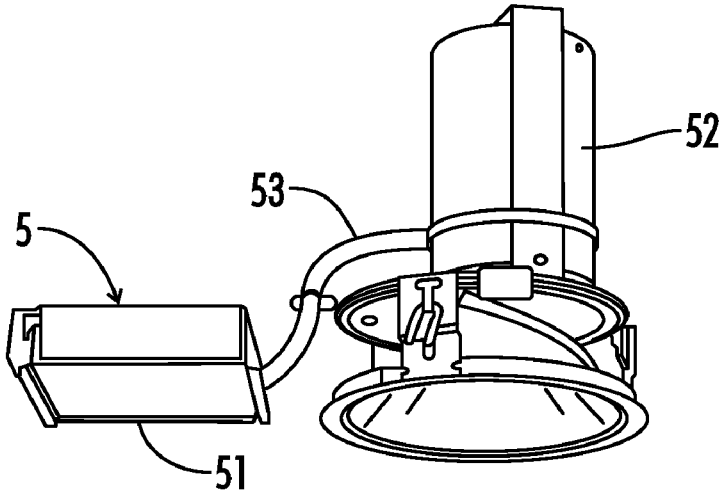
FIG. 21 is a perspective view showing an example of a lighting fixture using a ballast of the present invention.
Figure 22:
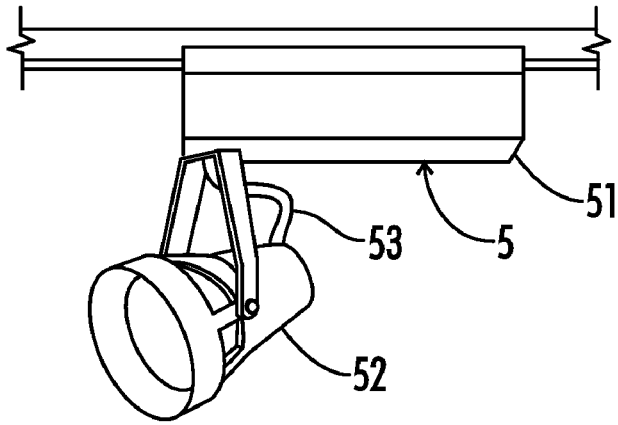
FIG. 22 is a perspective view showing another example of the lighting fixture using an embodiment of the present invention.
Figure 23:
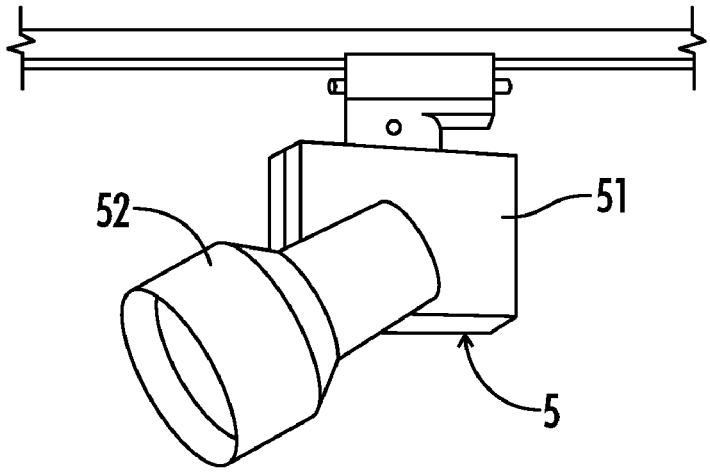
FIG. 23 is a perspective view showing further another example of the lighting fixture using an embodiment of the present invention.
Figure 24A:
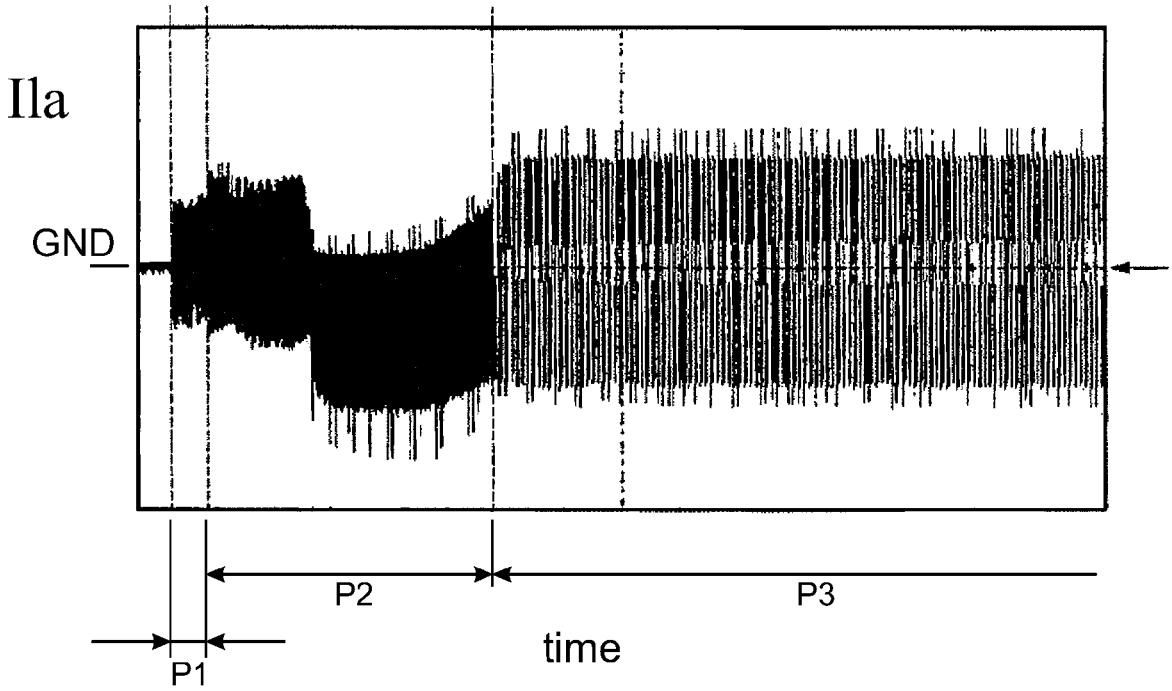
FIGS. 24*a* and 24*b* are explanatory diagrams of examples of a waveform in a lamp current, showing a case of having an insufficient duration of the filament heating operation in FIG. 24*a* and a case of having a sufficiently long duration of the filament heating operation in FIG. 24*b*.
Figure 24B:
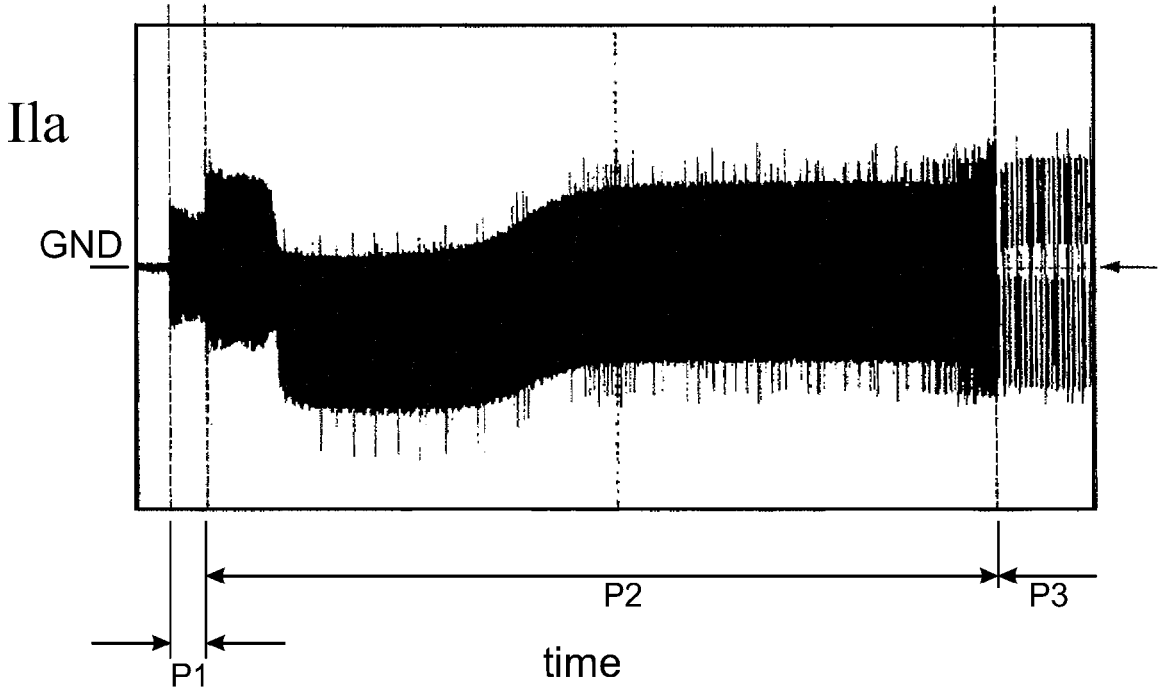

The aforementioned various embodiments of the ballast of the present invention can be used for lighting, for example, each of the lighting fixtures 5 shown in FIGS. 21 to 23. Each of the lighting fixtures 5 shown in FIGS. 21 to 23 includes a fixture main body 51 for storing the discharge lamp lighting device 1, and a lamp body 52 for holding the discharge lamp La. Each of the lighting fixtures 5 shown in FIGS. 21 and 22 also includes a power supply line 53 for electrically connecting the ballast 1 and the discharge lamp La.

Thus, although there have been described particular embodiments of the present invention of a new and useful Electronic Ballast with Controlled Filament Preheating Using Half-Wave Lamp Current Detection, it is not intended that such references be construed as limitations upon the scope of this invention except as set forth in the following claims.

What is claimed is:

1. An electronic ballast comprising:

a power converting circuit further comprising a plurality of switching elements and configured to receive DC power from a DC power source and output AC power to a discharge lamp;

a starting circuit connected between output ends of the power converting circuit, and configured to generate a high voltage for starting the discharge lamp;

a half-wave discharge detecting circuit configured for detecting an absolute value for each polarity peak of a current across the lamp, calculating an asymmetrical current value from the detected peaks and with respect to a predetermined current threshold, and detecting a half-wave discharge of the lamp wherein an absolute value of the asymmetrical current value is equal to or more than the current threshold for a predetermined determination time or longer; and a control circuit configured for controlling the switching elements of the power converting circuit in accordance with each of a starting operation wherein the starting circuit generates a high voltage and starts the lamp, a steady state operation wherein the power converting circuit outputs AC power for maintaining lighting of the discharge lamp, an filament heating operation wherein the power converting circuit provides an output frequency higher than that in steady state operation for heating each filament of the discharge lamp;

wherein the control circuit is further configured to perform a half-wave control process for reducing a half-wave discharge detected by the half-wave discharge detecting circuit during the filament heating operation and prior to steady-state operation.

2. The ballast of claim 1, the control circuit further configured to perform the half-wave control process by adjusting switch on-times of the switching elements in the power converting circuit and to increase a smaller peak value out of the detected peak values, relative to a larger peak value.

3. The ballast of claim 2, wherein the power converting circuit comprises a pair of switching elements to form a half bridge circuit, and the control circuit controls output power of the power converting circuit by a duty ratio obtained in turning on and off at least one switching element.

4. The ballast of claim 3, wherein the power converting circuit further includes a second pair of switching elements together with the first pair of switching elements to form a full bridge circuit, and the control circuit controls output power of the power converting circuit by a duty ratio obtained in turning on and off at least one switching element.

5. The ballast of claim 4, wherein the power converting circuit further includes a step-down chopper circuit for stepping down the received DC power, and the full bridge circuit for converting the DC power output from the step-down chopper circuit, the step-down chopper circuit further comprising a switching element coupled between an output end of the DC power source on a high voltage side and input end of the full bridge circuit.

6. The ballast of claim 5, wherein the control circuit controls power supplied to the discharge lamp by a duty ratio obtained in turning on and off the switching element in the step-down chopper circuit.

7. The ballast of claim 6, the starting circuit further comprising a primary winding portion of an autotransformer coupled between output ends of the power converting circuit and a tap of the autotransformer, the starting circuit further comprising a capacitor coupled between the tap of the autotransformer and a ground terminal.

8. An electronic ballast comprising:

a power converting circuit coupled to a power source and further comprising a plurality of switching elements for converting power from said power source and supplying said converted power to a discharge lamp;

a half-wave discharge detecting circuit coupled across the discharge lamp and configured for detecting a half-wave discharge of the lamp, said half-wave discharge present when an absolute value of an asymmetry in a current across the lamp exceeds a predetermined threshold for a predetermined determination time or longer; and a control circuit configured for controlling the switching elements of the power converting circuit, wherein the power converting circuit is controlled in a first control period to generate a high voltage for starting the lamp, in a second control period to generate power of a high output frequency for heating each filament of the lamp, and in a third control period to generate power of relatively low frequency for maintaining lighting of the discharge lamp;

the control circuit further configured to perform a half-wave control process for removing a half-wave discharge detected during the second control period, said process comprising controlling an on-time of at least one switching element to correct said lamp current asymmetry.

9. The ballast of claim 8, said second control period having a predetermined duration of time prior to the control circuit continuing to the third control period.

10. The ballast of claim 9, wherein the half-wave control process comprises superimposing a DC component on an output current of the power converting circuit.

11. The ballast of claim 9, wherein the half-wave control process comprises increasing an amplitude of an output current of the power converting circuit.

12. The ballast of claim 11, wherein the control circuit is configured to maintain throughout the predetermined duration of the second control period a constant adjustment amount of the small peak value obtained by the half-wave control process.

13. The ballast of claim 12, wherein the control circuit is configured to set the adjustment amount of the small peak value to a half of a difference of the detected peak values upon a first detection of the half-wave discharge within the second control period.

14. The ballast of claim 8, wherein the control circuit is configured to set a adjustment amount of the smaller peak value in accordance with a half-wave control process duration measured from a first detection of the half-wave discharge after starting the second control period.

15. The ballast of claim 14, the control circuit configured to make the adjustment amount of the smaller peak value larger with an increase in the duration of the second control period.

16. The ballast of claim 8, wherein the half-wave discharge detecting circuit is configured to detect an absolute value of a positive polarity lamp current and an absolute value of a negative polarity lamp current, wherein the control circuit is configured to change a adjustment amount of the smaller absolute peak value as needed in accordance with a difference between the detected peak values.

17. The ballast of claim 16, wherein the control circuit is configured to make the adjustment amount of the smaller peak value larger with an increase in the difference between the detected peak values.

18. The ballast of claim 17, wherein the control circuit is configured to prevent the adjustment amount of the smaller peak value from increasing beyond a predetermined upper limit value.

19. The ballast of claim 18, wherein the control circuit is configured to cause the power converting circuit to stop outputting AC power to the discharge lamp when half-wave discharge is detected upon completion of the second control period.

20. The ballast of claim 18, wherein the control circuit is configured to return to the first control period when half-wave discharge is detected upon completion of the second control period.

21. The ballast of claim 18, wherein the control circuit is configured to return to the first control period after causing the power converting circuit to stop outputting AC power to the discharge lamp for a predetermined period of time, when half-wave discharge is detected upon completion of the second control period.

22. The ballast of claim 18, wherein the control circuit is configured to count the number of times of returning from the second control period to the first control period, and to cause the power converting circuit to stop outputting AC power upon the number of times reaching a predetermined upper limit number of times.

23. A method of powering a discharge lamp using an electronic ballast having a power converter having a plurality of switching elements, a high-voltage starting circuit, and a control circuit, the method comprising:

(a) receiving input power at the power converter from a power source;

(b) providing a high voltage signal from the starting circuit for starting the lamp;

(c) after starting of the lamp, providing a high frequency signal from the converter to the lamp for heating filaments of the lamp;

(d) determining the presence or absence of a half-wave discharge from the lamp, said half-wave discharge comprising an asymmetry between absolute values of positive and negative polarities of a current across the lamp in excess of a predetermined threshold for a predetermined period of time;

(e) performing a half-wave control process further comprising controlling switch on-times in the power converter in accordance with the half-wave discharge determination;

(f) comparing a time lapse because lamp startup to a predetermined filament heating duration; and (g1) if the time lapse is less than the predetermined filament heating duration, returning to step (d) of the method, (g2) if the time lapse is equal to or greater than the predetermined filament heating duration, reducing the frequency of the signal from the power converter to the lamp for steady state operation.

24. The method of claim 23, wherein step (g2) comprises (g2) if the time lapse is equal to or greater than the predetermined filament heating duration, again determining the presence or absence of a half-wave discharge from the lamp;

the method further comprising the steps of (h1) if a half-wave discharge is present, halting power supply to the lamp, and (h2) if a half-wave discharge is not present, reducing the frequency of the signal from the power converter to the lamp for steady state operation.

25. The method of claim 24, step (h1) further comprising (h1) if a half-wave discharge is present, measuring a number of restarts and comparing the number of restarts to a restart threshold, wherein if the number of restarts is less than or equal to the restart threshold the method returns to step (b), and wherein if the number of restarts exceeds the restart threshold the power supply to the lamp is halted.

26. The method of claim 25, step (h1) further comprising (h1) if a half-wave discharge is present, halting power supply to the lamp for a predetermined time;

measuring a number of restarts;

comparing the number of restarts to a restart threshold, wherein if the number of restarts is less than or equal to the restart threshold the method returns to step (b), and wherein if the number of restarts exceeds the restart threshold the power supply to the lamp is halted.

* * * * *